US009469011B2

(12) United States Patent
Ogyu

(10) Patent No.: US 9,469,011 B2
(45) Date of Patent: Oct. 18, 2016

(54) GRINDER AND GRINDING MACHINE

(71) Applicant: MILANO SEISAKUSYO CO., LTD., Kawaguchi-shi, Saitama (JP)

(72) Inventor: Shingo Ogyu, Kawaguchi (JP)

(73) Assignee: MILANO SEISAKUSYO CO., LTD., Kawaguchi-Shi, Saitama (JP)

( * ) Notice: Subject to any disclaimer, the term of this patent is extended or adjusted under 35 U.S.C. 154(b) by 59 days.

(21) Appl. No.: 14/554,844

(22) Filed: Nov. 26, 2014

(65) Prior Publication Data

US 2015/0283663 A1 Oct. 8, 2015

(30) Foreign Application Priority Data

Apr. 8, 2014 (JP) ..... 2014-079535

(51) Int. Cl.
*B24B 7/22* (2006.01)

(52) U.S. Cl.
CPC ..... *B24B 7/224* (2013.01)

(58) Field of Classification Search
CPC ..... B24B 7/244; B24B 45/00; B24B 41/047
USPC ..... 451/280, 271, 272, 278, 353
See application file for complete search history.

(56) References Cited

U.S. PATENT DOCUMENTS 1,233,120 A * 7/1917 Patch ..... B24B 7/224 451/160
1,700,114 A * 1/1929 Thompson ..... B24B 23/04 15/22.2
1,738,394 A * 12/1929 Saporiti ..... B24B 7/224 451/160
3,053,063 A * 9/1962 Lilleberg ..... B24B 45/00 132/73.6
5,928,067 A * 7/1999 Hopper ..... B24B 41/047 451/259
5,980,361 A * 11/1999 Muller ..... B24B 37/30 451/288
6,478,663 B1 * 11/2002 Ganser ..... B24B 17/00 451/271

(Continued)

FOREIGN PATENT DOCUMENTS

JP H08-216018 A 8/1996
JP H10-076470 A 3/1998
JP 3072378 U 10/2000

OTHER PUBLICATIONS

Japanese Application 2014-079535, Office Action, May 13, 2014.

*Primary Examiner* — Joseph J Hail
*Assistant Examiner* — Henry Hong
(74) *Attorney, Agent, or Firm* — Manabu Kanesaka

(57) ABSTRACT

A grinder includes a rotatable disk to be pressed to a workpiece; a plurality of grinding bodies provided on one principal surface of the disk so as to cross a circumferential direction of the disk, each having a grinding stone chip on a side contacting the workpiece; and support devices, each supporting each of the grinding bodies so that the grinding stone chip swings with respect to the principal surface. Each support device supports each grinding body at a position at which an abrasion amount of the grinding stone chip is made uniform when the disk is rotated while being pressed to the workpiece so that a pressure to be applied to the grinding stone chip on an outer peripheral side of the disk becomes smaller than a pressure to be applied to the grinding stone chip on an inner peripheral side of the disk.

11 Claims, 4 Drawing Sheets

(56) References Cited

U.S. PATENT DOCUMENTS 6,551,179 B1 * 4/2003 Halley ..... B24B 37/24 451/285
7,063,602 B2 * 6/2006 Ling ..... B24B 19/226 451/278
7,942,726 B2 * 5/2011 Ling ..... B24B 19/226 451/271
2001/0021631 A1 * 9/2001 Minami ..... B24B 19/226 451/279
2004/0132392 A1 * 7/2004 Bohler ..... B24B 19/26 451/360
2010/0151775 A1 * 6/2010 Lampka ..... B24B 23/022 451/357
2011/0306280 A1 * 12/2011 Weder ..... B24B 7/18 451/259
2012/0270478 A1 * 10/2012 Duescher ..... B24B 37/107 451/59

* cited by examiner

GRINDER AND GRINDING MACHINE

TECHNICAL FIELD

The present invention relates to a grinder and a grinding machine, specifically, to uniformity of grinding when grinding stone chips abrade and uniformity of the abrasion amounts of the grinding stone chips.

BACKGROUND ART

When grinding a stone material, the surface of the stone material as a grinding workpiece is not perfectly flat, and in a narrow sense includes slopes, undulations, and curvatures. A grinding machine is structured to enable a grinder to which grinding stone chips are attached to tilt with respect to the grinding workpiece, so that even if the stone material surface includes slopes, etc., it can be excellently ground. However, the circumferential velocity differs between the outer peripheral side and the inner peripheral side of the rotary disk, so that the movement amount per 360-degree rotation of the disk is larger on the outer peripheral side. Therefore, the degree of abrasion of the grinding stone chip on the outer peripheral side is higher than that of the grinding stone chip on the inner peripheral side, so that the grinding stone chip on the outer peripheral side cannot come into contact with the workpiece.

On the other hand, for example, in Patent Document 1 described below, by increasing the number of grinding stone chips on the outer peripheral side of the rotary disk to be larger than the number of grinding stone chips on the inner peripheral side of the rotary disk, the degrees of abrasion are substantially made uniform. In Patent Document 2 described below, by forming the grinding surfaces of the grinding chips so that their widths in the circumferential direction become narrower toward the rotary shaft core side, the abrasion amounts are made uniform.

PRIOR ART DOCUMENTS

Patent Documents

Patent Document 1: Japanese Utility Model Registration No. 3072378

Patent Document 2: Japanese Published Unexamined Patent Application No. H10-76470

SUMMARY OF THE INVENTION

Problem to be Solved by the Invention

However, each of the techniques described in Patent Document 1 and Patent Document 2 described above has a problem in that the increase in the amount of grinding stones on the outer peripheral side causes all of the grinding stones to nearly uniformly abrade, so that the weight of the entire grinder increases.

The present invention was made in view of the above-described circumstances, and an object thereof is to provide a grinder and a grinding device capable of nearly uniformly coming into contact with a workpiece and grinding it even if grinding stone chips abrade. Another object of the present invention is to provide a grinder and a grinding machine capable of making uniform abrasion amounts of grinding stone chips.

Means for Solving the Problem

A grinder according to the present invention includes a substantially discoid disk that is rotatable and pressed to a workpiece, a plurality of grinding bodies that are provided on one principal surface of the disk so as to cross the circumferential direction of the disk and have grinding stone chips on the side come into contact with the workpiece, and support means that support the grinding bodies so that the grinding stone chips swing with respect to the principal surface, and the support means support the grinding bodies at positions at which abrasion amounts of the grinding stone chips are made uniform when the disk is rotated while being pressed to the workpiece by supporting the grinding bodies at positions deviated to the inner peripheral side from the centers in the longitudinal directions of the grinding bodies so as to make a pressure to be applied to the grinding stone chip on the outer peripheral side of the disk smaller than a pressure to be applied to the grinding stone chip on the inner peripheral side of the disk.

According to one of main embodiments, the grinding bodies are disposed radially on the one principal surface.

A grinding device according to the present invention includes either of the grinders described above, a rotary shaft to which the grinder is removably attached, a driving means for rotatively driving the rotary shaft, and a pressurizing means for pressing the rotary shaft to the workpiece side. According to one of the main embodiments, the grinder is attached to the rotary shaft so that the one principal surface follows a to-be-machined surface of the workpiece. According to another embodiment, a movement mechanism that moves at least one of the grinder and the workpiece is provided to make the grinder and the workpiece movable relative to each other. The above-described and other objects, features, and advantages of the present invention will become clear from the following detailed description and accompanying drawings.

Effects of the Invention

According to the present invention, on one principal surface of a substantially discoid disk that is pressed to a workpiece, a plurality of grinding bodies are provided so as to cross the circumferential direction of the disk, and the grinding bodies are supported by support means so that the grinding stone chips swing with respect to the principal surface. In this case, the support means support the grinding bodies at positions deviated to the inner peripheral side from the centers in the longitudinal direction of the grinding bodies so that a pressure to be applied to the grinding stone chip on the outer peripheral side of the disk becomes smaller than a pressure to be applied to the grinding stone chip on the inner peripheral side of the disk. Accordingly, when the disk is rotated while being pressed to the workpiece, the grinding bodies can be supported at positions at which the abrasion amounts of the grinding stone chips are made uniform. In addition, even if the grinding stone chips abrade, they nearly uniformly come into contact with the workpiece, and easily follow the surface of the workpiece, so that uniform grinding is realized.

BRIEF DESCRIPTION OF THE DRAWINGS

FIGS. 2(A)-2(C) are drawings showing a grinder according to Example 1, wherein FIG. 2(A) is a perspective view of the grinder from the surface on the grinding body side, FIG. 2(B) is a diagram showing a method for fixing grinding stone chips, and FIG. 2(C) is an explanatory view showing support positions of the grinding bodies.

BEST MODE FOR CARRYING OUT THE INVENTION

Hereinafter, best modes for carrying out the present invention are described in detail based on examples.

Example 1

Figure 1:
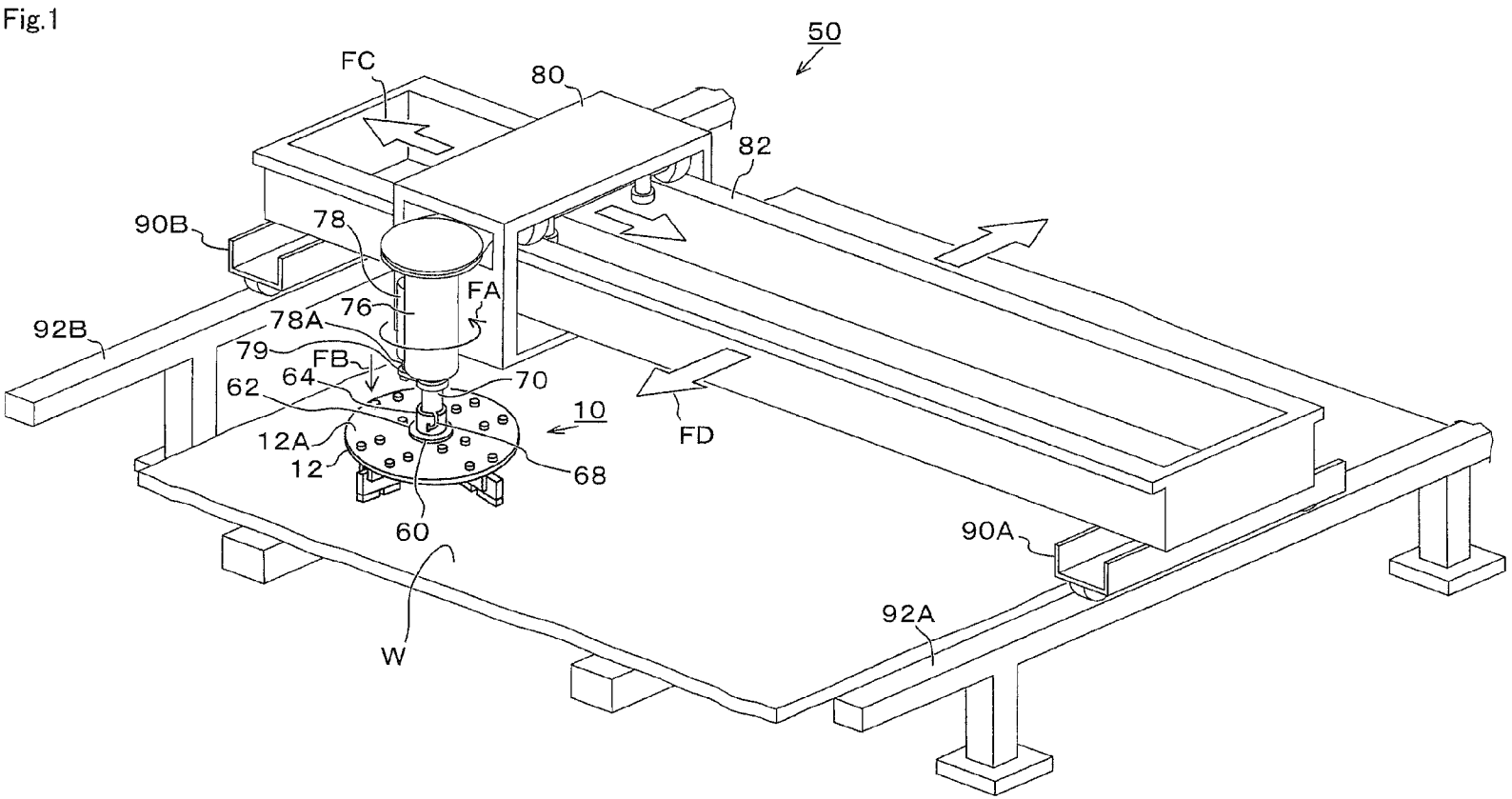
FIG. 1 is a view showing an entire constitution of a grinding machine according to Example 1 of the present invention.
Figure 2:
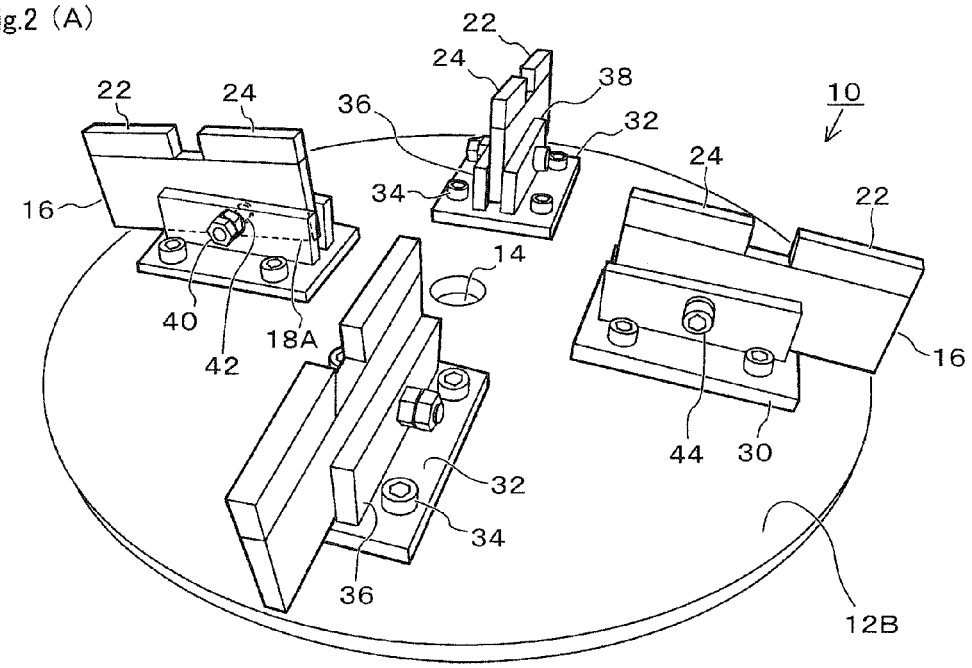
Figure 2:
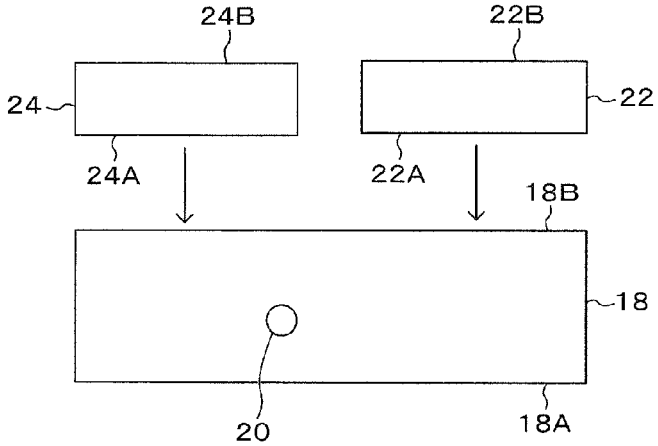
Figure 2:
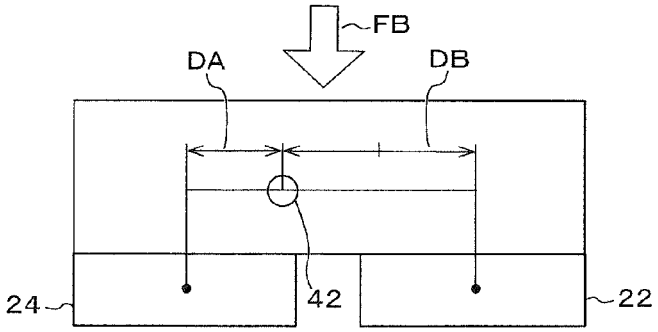

First, Example 1 of the present invention is described with reference to FIG. 1 to FIG. 3. FIG. 1 is an external perspective view showing an entire constitution of a grinding machine according to the present example. As shown in FIG. 1, a grinding machine 50 according to the present example is for grinding the surface of a workpiece W such as a stone material, and the present example is an example of a single-spindle type. The grinding machine 50 has a grinder 10 attached to the tip end of a rotary shaft 70 provided on a spindle 76, and the grinder 10 is rotatable as shown by the arrow FA in the same drawing. Lateral to the spindle 76, a hydraulic cylinder 78 is provided as the pressurizing means for pressing the rotary shaft 70 to the workpiece W side (refer to the arrow FB). The rod 78A of the hydraulic cylinder 78 is joined to the rotary shaft 70 by a joint member 79. Further, the spindle 76 is an automatic traveling type movable along the surface of the workpiece W.

For example, a slider 80 to which the spindle 76 is attached can reciprocate in the direction shown by the arrow FC in FIG. 1 along a guide 82 disposed above the workpiece W. Both ends of the guide 82 are supported by sliders 90A and 90B, and these sliders 90A and 90B can reciprocate in the direction shown by the arrow FD in FIG. 1 along a pair of rails 92A and 92B disposed in a direction orthogonal to the guide 82. The rotary drive mechanism of the rotary shaft 70, the pressurizing mechanism using the hydraulic cylinder 78, and the reciprocating mechanism of the sliders 80, 90A, and 90B are known, so that descriptions of these are omitted.

Next, the grinder 10 is described. FIG. 2 are drawings showing a grinder according to the present example, and FIG. 2(A) is a perspective view of the grinder from the surface on a grinding body 16 side, FIG. 2(B) is a diagram showing a method for fixing grinding stone chips, and FIG. 2(C) is an explanatory view showing support positions of the grinding bodies. The grinder 10 consists of a substantially discoid disk 12, a plurality of grinding bodies 16 provided on one principal surface 12B of the disk 12, and support bodies 30 that support the grinding bodies 16 swingably. At the center of the disk 12, a through hole 14 is formed.

The grinding body 16 is constituted by providing grinding stone chips 22 and 24 at an appropriate interval on the upper principal surface 18B of a rectangular plate 18 in the example shown in the drawings. In the example shown in the drawings, four grinding bodies 16 are provided radially. One grinding stone chip 22 is positioned on the outer peripheral side of the disk 12, and the other grinding chip 24 is positioned on the inner peripheral side of the disk 12. As the grinding stone chips 22 and 24, known grinding chips, for example, diamond chips, etc., can be used. These grinding stone chips 22 and 24 are attached to both sides of the plate principal surface 18B by, for example, brazing the lower principal surfaces 22A and 24A of the grinding stone chips 22 and 24, as shown in FIG. 2(B). In the plate 18, at a position closer to the inner periphery than the center in the longitudinal direction, a through hole 20 is formed. "Upper" and "lower" referred to herein mean upper and lower sides in the state shown in FIG. 2(A) and FIG. 2(B), and in the state shown in FIG. 1 and FIG. 3, the upper and lower sides are inverted.

The support body 30 that supports the grinding body 16 includes, as shown in FIG. 2(A), a tabular attaching plate 32 to be fixed to the principal surface 12B of the disk 12 by fixtures 34 such as bolts, and a pair of support plates 36 and 38 fixed so as to become orthogonal to the attaching plate 32. These support plates 36 and 38 are disposed at an appropriate interval so as to sandwich the plate 18 of the grinding body 16. The support plates 36 and 38 are fixed to the attaching plate 32 by, for example, welding, etc. In these support plates 36 and 39, a through hole not shown through which a shaft portion 42 of a bolt 40 for supporting the grinding body 16 penetrates is formed.

The grinding body 16 is sandwiched between the pair of support plates 36 and 38 of the support body 30, the positions of the through hole 20 of the grinding body 16 and the through holes not shown of the support plates 36 and 38 are aligned with each other, and as shown in FIG. 2(A), the grinding body 16 is fixed by the bolt 40 and nut 44. Accordingly, the grinding body 16 is supported turnably by the shaft portion 42 of the bolt 40. Here, by setting the distance IA (refer to FIG. 3(A)) from the principal surface 18A of the plate 18 to the shaft portion 42 to be shorter than the distance IB from the attaching plate 32 to the shaft portion 42, the grinding body 16 becomes swingable with respect to the principal surface 12B of the disk 12.

The support positions of the grinding bodies 16 are described with reference to FIG. 2(C). FIG. 2(C) corresponds to a state where the upper and lower sides in FIG. 2(B) are inverted. If the penetrating position of the shaft portion 42 is at the center position in the longitudinal direction of the plate 18, when the rotary shaft 70 is pressed to the workpiece W by the hydraulic cylinder 78, the pressures to be applied to the inner peripheral side and the outer peripheral side of the shaft portion 42 as a boundary become equal to each other. In this case, as in the background art, the abrasion amount of the grinding stone chip 22 on the outer peripheral side on which a peripheral velocity is higher increases, and this grinding stone chip cannot come into contact with the workpiece W. Therefore, in the present invention, the abrasion amounts of the grinding stone chips 22 and 24 on the inner peripheral side and the outer peripheral side of the shaft portion 42 as a boundary are made nearly uniform by changing the pressures to be applied to the grinding stone chips 22 and 24. That is, by deviating the shaft portion 42 from the center in the longitudinal direction of the plate 18 toward the inner periphery, the pressure to be applied to the inner peripheral side becomes higher than the pressure to be applied to the outer peripheral side, and the grinding stone chip 24 on the inner peripheral side and the grinding stone chip 22 on the outer peripheral side nearly uniformly abrade.

In a more detailed description, as shown in FIG. 2(C), the distance from the point of intersection between a vertical line passing through the center of the grinding stone chip 24 on the inner peripheral side and a horizontal line passing through the center of the shaft portion 42 to the center of the shaft portion 42 is defined as DA, and the distance from the point of intersection between a vertical line passing through the center of the grinding stone chip 22 on the outer peripheral side and the horizontal line to the center of the shaft portion 42 is defined as DB. In the present example, DB is set to be twice as large as DA so that the pressure to be applied to the grinding stone chip 24 on the inner peripheral side becomes twice as high as the pressure to be applied to the grinding stone chip 22 on the outer peripheral side. With this constitution, the abrasion amounts on the outer peripheral side and the inner peripheral side become nearly uniform. Even if the abrasion amounts on the outer peripheral side and the inner peripheral side become different, by swinging of the grinding body 16 around the shaft portion 42 as a fulcrum, the entireties of the principal surfaces 22B and 24B of the grinding stone chips 22 and 24 always come into contact with the surface of the workpiece W, so that the workpiece W can be nearly uniformly ground.

Figure 3A:
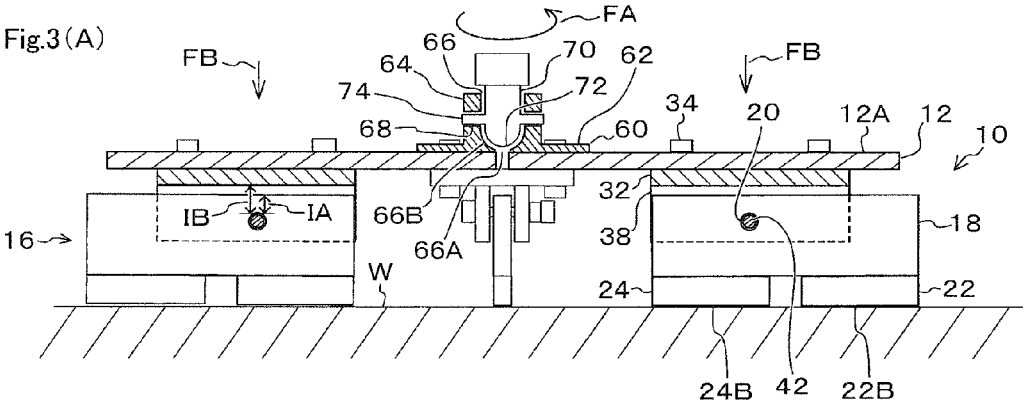
FIG. 3(A) and FIG. 3(B) are side views showing operation of the Example 1.

The grinder 10 constituted as described above is removably attached to the rotary shaft 70 via a joint member 60 provided on the other principal surface 12A of the disk 12 as shown in FIG. 1. The joint member 60 includes, as shown in FIG. 3(A), a substantially circular fixed plate 62 and a substantially cylindrical cylinder portion 64. The cylinder portion 64 has a groove 68 on the side surface as shown in FIG. 1. On the lower side of the hollow portion 66 of the cylinder portion 64, a through hole 66A and a curved surface portion 66B are formed. On the other hand, the rotary shaft 70 has a tip end 72 formed to be curved, and a pin 74 projecting in a radial direction on the outer peripheral surface. By engaging this pin 74 in the groove 68 of the cylinder portion 64, the grinder 10 is removably attached to the rotary shaft 70.

Although not shown, the rotary shaft 70 is hollow to allow cooling water to pass through, and this cooling water passes through the through hole 66A of the joint member 60 and the through hole 14 of the disk 12 and cools the machined portion. The outer diameter of the rotary shaft 70 is set to be slightly smaller than the inner diameter of the cylinder portion 64 and the cylinder portion 64 can tilt with respect to the rotary shaft 70. Therefore, the grinder 10 can tilt with respect to the rotary shaft 70 and follow the surface shape of the workpiece W. The method for joining this grinder 10 and the rotary shaft 70 is known.

Figure 3B:
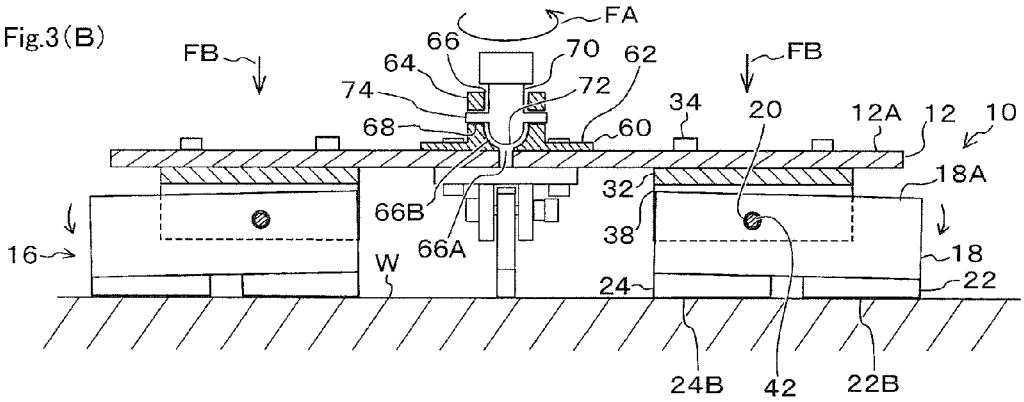

Next, operation of the present example is described with reference to FIG. 3 as well. As shown in FIG. 3(A), the grinder 10 is attached to the rotary shaft 70, and the grinding stone chips 22 and 24 are brought into contact with and pressed against the surface of the workpiece W by driving of the hydraulic cylinder 78. In this pressed state, the grinder 10 is rotated via the rotary shaft 70 to perform grinding. At this time, as described above, the position of the shaft portion 42 supporting the grinding body 16 is set on the inner peripheral side, so that even when grinding progresses, the abrasion amounts of the grinding stone chip 22 on the outer peripheral side and the grinding stone chip 24 on the inner peripheral side become substantially equal to each other, and nearly uniform grinding can be performed. Even if a slight difference occurs in grinding amount, in the present example, the grinding body 16 is supported swingably with respect to the disk principal surface 12B by the support body 30. Therefore, the grinding body 16 swings around the shaft portion 42 as a fulcrum as shown by the arrow in FIG. 3(B), and the entireties of the principal surfaces 22B and 24B of the grinding stone chips 22 and 24 nearly uniformly come into contact with the workpiece W. At the start of grinding of the workpiece W, surface roughness of the workpiece W is great, however, since the grinder 10 is structured so as to easily follow the workpiece W by tilting with respect to the rotary shaft 70 and the grinding bodies 16 swing with respect to the disk 12, the grinder 10 still more easily follows the workpiece W.

Thus, according to Example 1, the following effects are obtained.

(1) A plurality of grinding bodies 16 are provided radially on one principal surface 12B of the substantially discoid rotatable disk 12, and the positions of the grinding bodies 16 close to the inner periphery are supported by the support bodies 30. Therefore, when the disk 12 is rotated while being pressed to the workpiece W, the grinding stone chips 22 and 24 of the grinding bodies 16 nearly uniformly abrade.

(2) The grinding bodies 16 are supported swingably by the shaft portions 42, so that even if the abrasion amounts differ between the grinding stone chip 22 on the outer peripheral side and the grinding stone chip 24 on the inner peripheral side, the entireties of the principal surfaces 22B and 24B of the grinding stone chips 22 and 24 swing so as to come into contact with the workpiece W. As a result, even if the grinding stone chip abrasion amounts differ between the outer peripheral side and the inner peripheral side, nearly uniform grinding can be performed.

(3) The grinder 10 is attached so as to be tiltable with respect to the rotary shaft 70, so that grinding along the shape of the workpiece W can be performed.

(4) The grinding bodies 16 can swing with respect to the disk 12, so that they more easily follow the shape of the workpiece W.

The present invention is not limited to the example described above, and can be variously modified without departing from the spirit of the present invention. For example, the present invention also includes the following.

(1) The shapes, dimensions, and materials shown in the example are just examples, and can be changed as appropriate. For example, in the example described above, the plate 18 to which the grinding stone chips 22 and 24 are attached is substantially rectangular, however, as long as swinging is not obstructed, it can be changed in such a manner that the corners on both ends of the principal surface 18A of the plate 18 are rounded.

(2) In the example described above, four grinding bodies 16 are provided radially, however, the number and positions of the grinding bodies 16 can be changed as appropriate. For example, even if the grinding bodies 16 are not provided perfectly radially, the same effects as those of Example 1 described above can be obtained as long as the grinding bodies are disposed so as to cross the circumferential direction of the disk 12.

(3) The support body 30 shown in the example described above is also an example, and the design can be changed as appropriate within the scope in which the same effects are obtained. For example, the lengths of DA and DB shown in FIG. 2(C) are also an example, and it is also possible that the support body 30 supports the grinding body 16 swingably around a portion near the center of the grinding body 16 as a fulcrum. In this case, the pressures to be applied to the inner peripheral side and the outer peripheral side of the shaft portion 42 as a boundary are equal to each other, and due to swinging of the grinding body 16, even if the abrasion amounts of the grinding stone chips 22 and 24 become different, the grinding stone chips 22 and 24 can be nearly uniformly brought into contact with the workpiece W.

(4) The joint mechanism between the grinder 10 and the rotary shaft 70 shown in the example described above is also an example, and various known mechanisms can also be used. In the example described above, the grinder 10 is joined so as to be tiltable with respect to the rotary shaft 70, and this is also an example, and the grinder may be joined so as not to tilt.

(5) In the grinding machine 50 according to the example described above, the grinder 10 moves with respect to the workpiece W, and this is also an example, and it is also possible that the workpiece W side moves, or both of the grinder 10 and the workpiece W are movable.

(6) In the example described above, grinding of the upper surface of the planar workpiece W is described by way of example, and this is also an example, and it is also possible that, according to the shape, etc., of the workpiece W, the disk 12 of the grinder 10 is supported vertically to grind the side surface or the like of the workpiece W.

(7) In the example described above, the grinding stone chips 22 and 24 are attached at an appropriate interval to the plate principal surface 18B, and this is also an example, and it is also allowed that three or more chips are attached, or one chip is provided. For example, it is also possible that setting is made to make different the number of chips according to roughness of the grinding stones.

Figure 4:
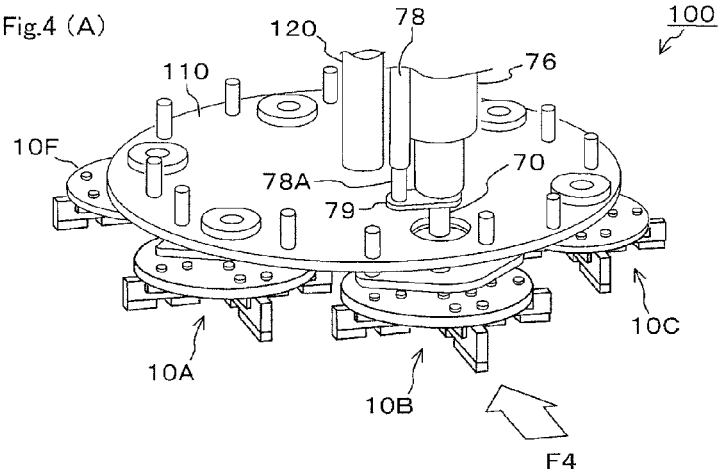
FIG. 4(A) is an external perspective view showing an essential portion of another example of the present invention.
FIG. 4(B) is a side view from the arrow F4 in FIG. 4(A).
Figure 4B:
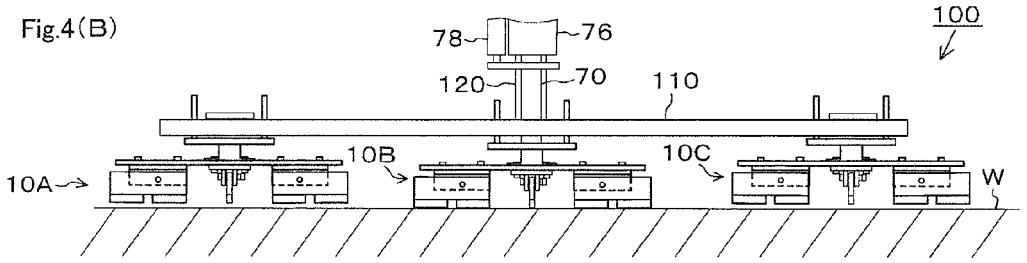

(8) In the example described above, a single-spindle type grinding machine is shown, and this is also an example, and the grinder of the present invention is also applicable to multi-spindle type grinding machines. For example, like a grinding machine 100 shown in FIG. 4(A) and FIG. 4(B), a constitution can also be adopted in which a plurality of grinders 10A to 10F with different grit numbers are attached to an attaching disk 110, and according to a workpiece W, the grinder to be connected to the rotary shaft 70 is automatically changed. The attaching disk 110 itself is made rotatable by a rotary shaft 120 provided in nearly the center, and is driven only when the grinder to be connected to the rotary shaft 70 is changed among the grinders 10A to 10F.

(9) A workpiece to be ground according to the present invention is preferably a stone material by way of example, however, without limiting to this, the present invention is also applicable to, for example, an artificial stonework.

INDUSTRIAL APPLICABILITY

According to the present invention, on one of the principal surfaces of a substantially discoid disk that is rotatable and pressed to a workpiece, a plurality of grinding bodies are provided so as to cross the circumferential direction of the disk, and the grinding bodies are supported so that the grinding stone chips swing with respect to the principal surface. At this time, the support means support the grinding bodies at positions deviated to the inner peripheral side from the centers in the longitudinal direction of the grinding bodies so that the pressure to be applied to the grinding stone chip on the outer peripheral side of the disk becomes smaller than the pressure to be applied to the grinding stone chip on the inner peripheral side of the disk. Accordingly, when the disk is rotated while being pressed to the workpiece, the grinding bodies are supported at positions at which the abrasion amounts of the grinding stone chips become uniform, and even if the grinding stone chips abrade, they nearly uniformly come into contact with the workpiece and easily follow the surface of the workpiece. Therefore, the present invention is applicable to uses of grinders and grinding machines.

DESCRIPTION OF REFERENCE SYMBOLS

10, 10A to 10F: grinder
12: disk
12A, 12B: principal surface
14: through hole
16: grinding body
18: plate
18A, 18B: principal surface
20: through hole
22, 24: grinding stone chip
22A, 22B, 24A, 24B: principal surface
30: support body
32: attaching plate
34: fixture
36, 38: support plate
40: bolt
42: shaft portion
44: nut
50: grinding machine
60: joint member
62: fixed plate
64: cylinder portion
66: hollow portion
66A: through hole
66B: curved surface portion
68: groove
70: rotary shaft
72: tip end
74: pin
76: spindle
78: hydraulic cylinder
78A: rod
79: joint member
80: slider
82: guide
90A, 90B: slider
92A, 92B: rail
100: grinding machine
110: attaching disk
W: workpiece

What is claimed is:

1. A grinder comprising:

a substantially discoid disk that is rotatable around a rotation axis of the disk and is adapted to be pressed to a workpiece;

a plurality of grinding bodies provided on one principal surface of the disk so that the plurality of grinding bodies extends radially outwardly from the rotation axis of the disk, each of the plurality of grinding bodies having a grinding stone chip on a side contacting the workpiece; and support devices attached to the disk, each supporting device supporting the each of the plurality of grinding bodies so that the grinding stone chip swings with respect to the principal surface, wherein each of the support devices has a supporting point supporting the each of the plurality of grinding bodies so that an abrasion amount of the grinding stone chip is made uniform when the disk is rotated while being pressed to the workpiece, the supporting point being deviated to an inner peripheral side from a center in a longitudinal direction of each the plurality of grinding bodies so that a pressure to be applied to the grinding stone chip on an outer peripheral side of the disk becomes smaller than a pressure to be applied to the grinding stone chip on an inner peripheral side of the disk.

2. The grinder according to claim 1, wherein the plurality of grinding bodies is disposed at an equal distance from the rotation axis of the disk.

3. A grinding device comprising:

a grinder grinding a workpiece;

a rotary shaft to which the grinder is removably attached;

a driving device for rotatively driving the rotary shaft; and a pressurizing device for pressing the rotary shaft to the workpiece side, wherein the grinder comprises a substantially discoid disk that is rotatable around the rotary shaft and is adapted to be pressed to the workpiece, a plurality of grinding bodies provided on one principal surface of the disk so that the plurality of grinding bodies extends radially outwardly from the rotary shaft, each of the plurality of grinding bodies having a grinding stone chip on a side contacting the workpiece; and support devices attached to the disk, each support device supporting the each of the plurality of grinding bodies so that the grinding stone chip swings with respect to the principal surface, and wherein each of the support devices has a supporting point supporting the each of the plurality of grinding bodies so that an abrasion amount of the grinding stone chip is made uniform when the disk is rotated while being pressed to the workpiece, the supporting point being deviated to an inner peripheral side from a center in a longitudinal direction of each the plurality of grinding bodies so that a pressure to be applied to the grinding stone chip on an outer peripheral side of the disk becomes smaller than a pressure to be applied to the grinding stone chip on an inner peripheral side of the disk.

4. A grinding device comprising:

a grinder grinding a workpiece;

a rotary shaft to which the grinder is removably attached;

a driving device for rotatively driving the rotary shaft; and a pressurizing device for pressing the rotary shaft to the workpiece side, wherein the grinder comprises a substantially discoid disk that is rotatable around the rotary shaft and is adapted to be pressed to the workpiece, a plurality of grinding bodies provided on one principal surface of the disk so that the plurality of grinding bodies extends radially outwardly from the rotary shaft and equally spaced from the rotary shaft, each of the plurality of grinding bodies having a grinding stone chip on a side contacting the workpiece; and support devices attached to the disk, each support device supporting the each of the plurality of grinding bodies so that the grinding stone chip swings with respect to the principal surface, and wherein each of the support devices has a supporting point supporting the each of the plurality of grinding bodies so that an abrasion amount of the grinding stone chip is made uniform when the disk is rotated while being pressed to the workpiece, the supporting point being deviated to an inner peripheral side from a center in a longitudinal direction of each the plurality of grinding bodies so that a pressure to be applied to the grinding stone chip on an outer peripheral side of the disk becomes smaller than a pressure to be applied to the grinding stone chip on an inner peripheral side of the disk.

5. The grinding device according to claim 3, wherein the grinder is attached to the rotary shaft so that the one principal surface follows a surface, to be machined, of the workpiece.

6. The grinding device according to claim 4, wherein the grinder is attached to the rotary shaft so that the one principal surface follows a surface, to be machined, of the workpiece.

7. The grinding device according to claim 3, further comprising a movement mechanism that moves at least one of the grinder and the workpiece relative to another of the grinder and the workpiece.

8. The grinding device according to claim 4, further comprising a movement mechanism that moves at least one of the grinder and the workpiece relative to another of the grinder and the workpiece.

9. The grinding device according to claim 5, further comprising a movement mechanism that moves at least one of the grinder and the workpiece relative to another of the grinder and the workpiece.

10. The grinding device according to claim 6, further comprising a movement mechanism that moves at least one of the grinder and the workpiece relative to another of the grinder and the workpiece.

11. The grinding device according to claim 1, wherein the each of the plurality of grinding bodies has a shaft portion connecting the each of the plurality of grinding bodies and the each of the support devices, and a distance of a horizontal line horizontal to each of the longitudinal directions of the each of the plurality of grinding bodies extending from a center of the shaft portion to a vertical line vertical to the each of the longitudinal directions of the each of the plurality of grinding bodies extending from a center of the grinding stone chip on the outer peripheral side of the disk is twice as much long as a distance of the horizontal line horizontal to the each of the longitudinal directions of the each of the plurality of grinding bodies extending from the center of the shaft portion to a vertical line vertical to the each of the longitudinal directions of the each of the plurality of grinding bodies extending from a center of the grinding stone chip on the inner peripheral side of the disk.

* * * * *